United States Patent [19]

Michely

[11] Patent Number: 4,834,672

[45] Date of Patent: May 30, 1989

[54] CONNECTOR

[76] Inventor: Alfred Michely, Holzerplatz 1, D-6601 Heusweiler 2, Fed. Rep. of Germany

[21] Appl. No.: 41,133

[22] PCT Filed: May 21, 1986

[86] PCT No.: PCT/DE86/00215

§ 371 Date: Mar. 20, 1987

§ 102(e) Date: Mar. 20, 1987

[87] PCT Pub. No.: WO86/07199

PCT Pub. Date: Dec. 4, 1986

[30] Foreign Application Priority Data

May 21, 1985 [DE] Fed. Rep. of Germany ..... 3518228
May 21, 1985 [DE] Fed. Rep. of Germany ..... 3518229

[51] Int. Cl.[4] ..... H01R 4/24
[52] U.S. Cl. ..... 439/417; 439/425
[58] Field of Search ..... 439/391, 395, 396, 397, 439/400, 404, 406, 417, 418, 425

[56] References Cited

U.S. PATENT DOCUMENTS 3,510,827 5/1970 Spangler .
4,407,557 10/1983 Hayes ..... 439/396

FOREIGN PATENT DOCUMENTS 7045991 12/1970 Fed. Rep. of Germany .
2042692 3/1971 Fed. Rep. of Germany .
1765200 7/1971 Fed. Rep. of Germany .
1765880 4/1972 Fed. Rep. of Germany .
2232556 1/1973 Fed. Rep. of Germany .
2401504 3/1975 Fed. Rep. of Germany .
7818113 6/1978 Fed. Rep. of Germany .
1534124 6/1968 France .
2058620 5/1971 France .
7915655 1/1981 France .
8100259 7/1982 France .
543817 12/1973 Switzerland .
2130816 6/1984 United Kingdom .

*Primary Examiner*—Joseph H. McGlynn
*Attorney, Agent, or Firm*—Spencer & Frank

[57] ABSTRACT

A connector which is intended for the connection of a line without prior removal of its insulating case includes a base in which a contact pressure member carrying a contact element is disposed. The connector also includes a counterpressure member such that between the contact pressure member and the counterpressure member, a conductor which is to be connected, can be held. The force for transferring the contact pressure and counterpressure members into a clamping position is transmitted by a adjustment spring which has its travel determined by a stop and this stop therefore regulates the subsequent transfer of force. A centering and constricting device includes side pieces formed partly by the counterpressure member which when the connector is moved into its clamping position, center the conductor on the contact element and press together as a result of forces which are directed at least approximately towards the longitudinal axis of the conductor.

22 Claims, 11 Drawing Sheets

FIG. 1
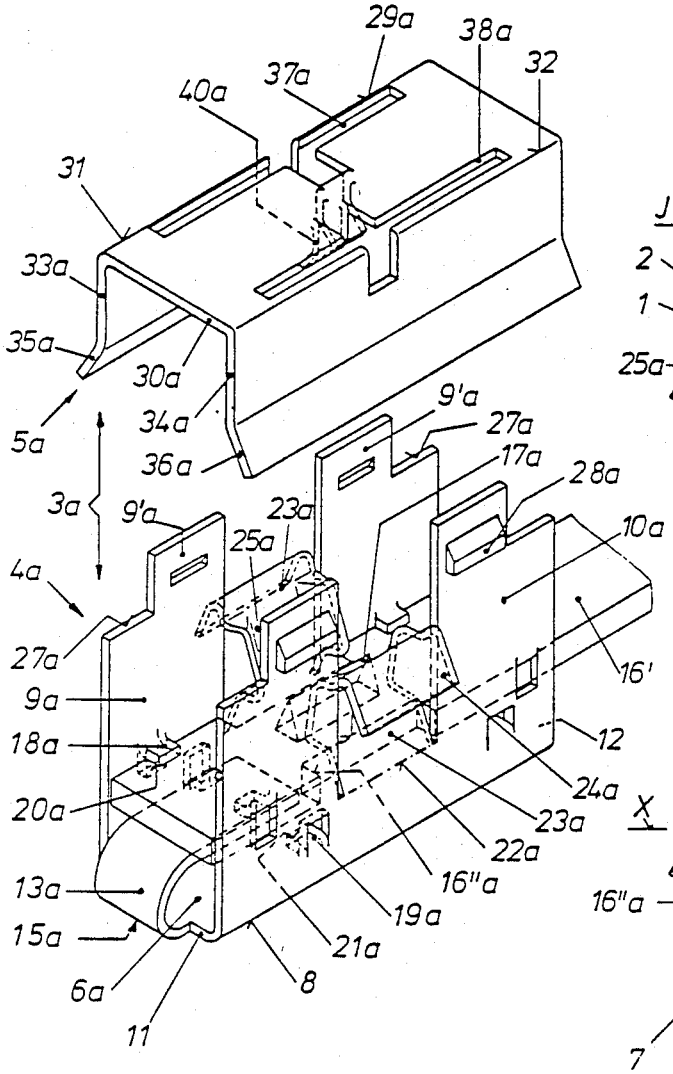
FIG. 2
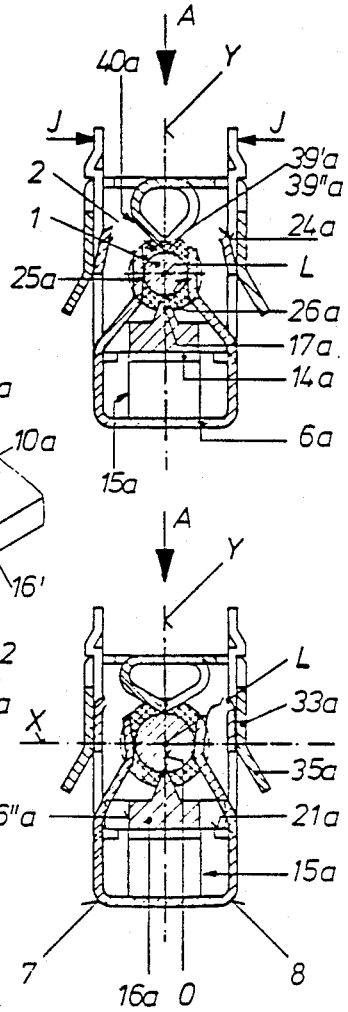
FIG. 3

FIG.15
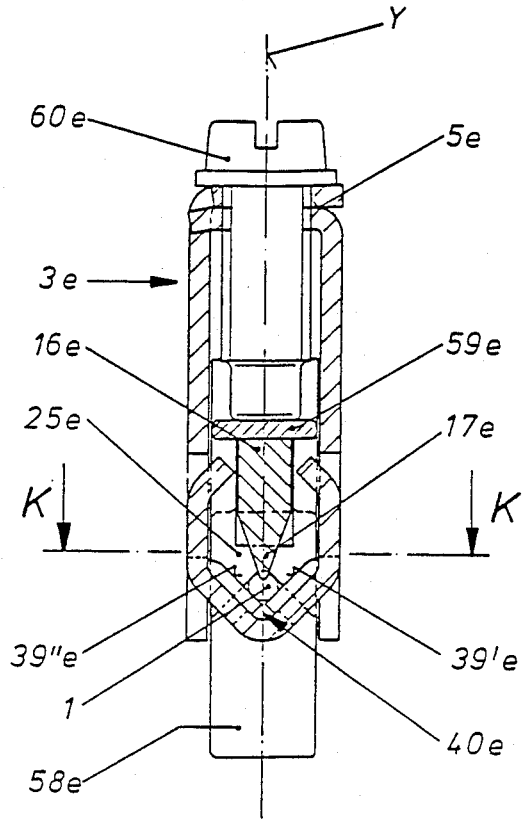
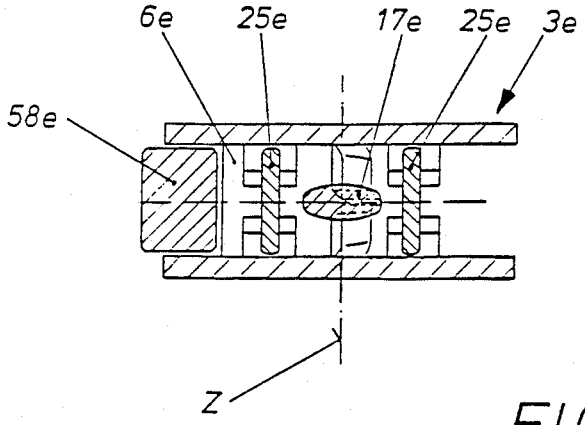
FIG. 16

FIG. 19
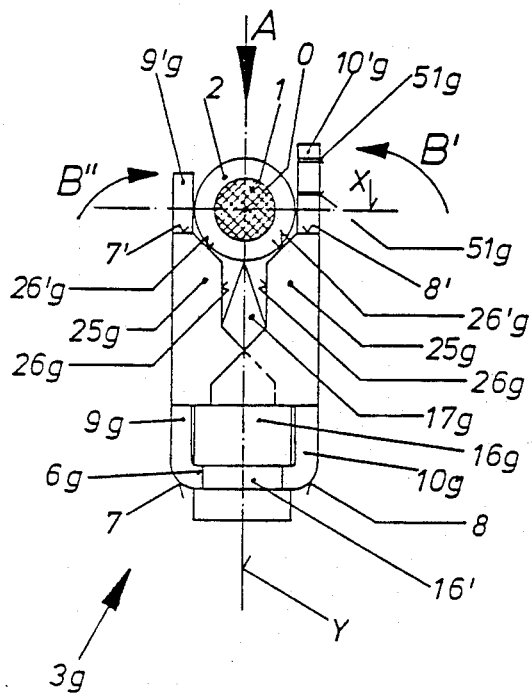
FIG. 20
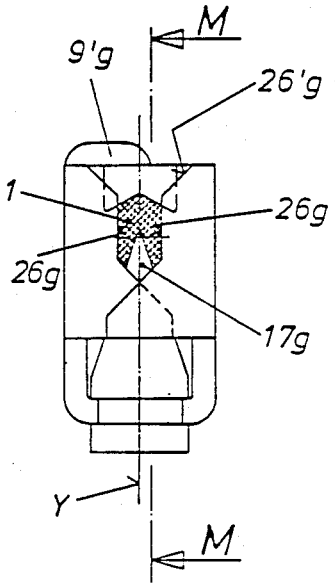
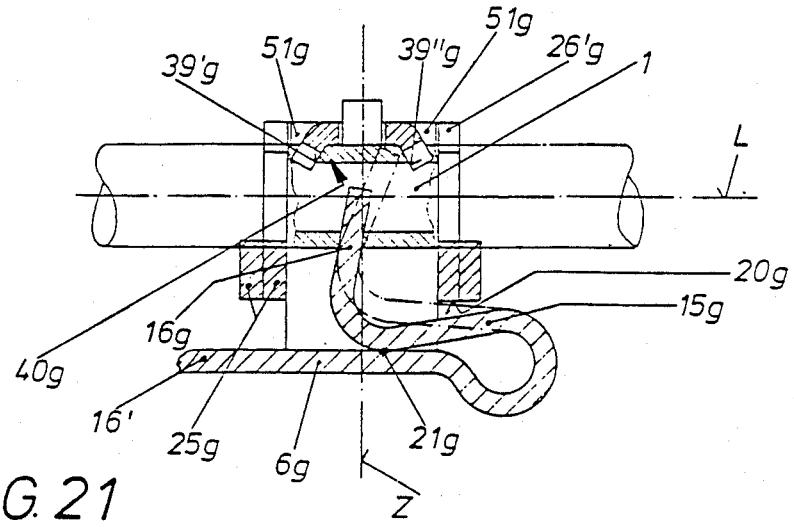
FIG. 21

FIG. 23
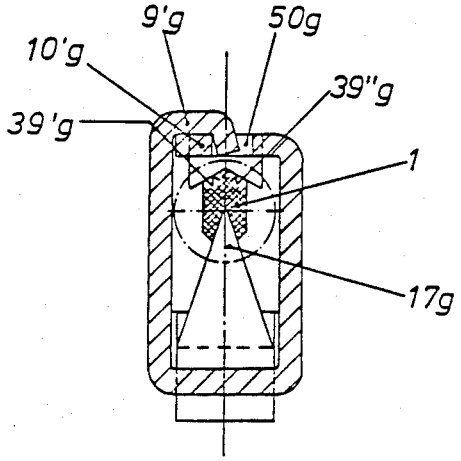
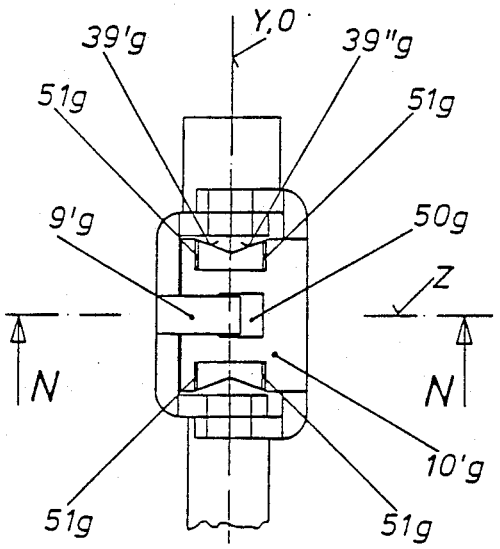
FIG. 22

CONNECTOR

BACKGROUND OF THE INVENTION

1. Field of the Invention

The invention relates to a connector for the electrically conductive connection of a line without prior removal of its insulating sheaths, whose diameter is equal to or less than a given maximum value and which encloses a single or multiple wire metal conductor. The conductor has a diameter which is equal to or less than a given maximum value and which has a cross section that is at least approximately circular, and the connector has at least one clamping chamber which is open at its frontal faces and into which a length section of the line to be connected can be introduced. The longitudinal axis of the connector is defined by the longitudinal axis of such a length section of a line whose insulating sheath has a diameter corresponding to the given maximum value and is disposed in the clamping chamber when the connector is in the receiving position. The connector includes a connector body, at least one contact pressure member, each having at least one conical or wedge-shaped contacting element intended for penetration of the insulating sheath and entrance into the conductor. The tip of the contacting element or its cutting edge, respectively, lies in a first longitudinal center plane of the connector which also contains the longitudinal axis of the connector. The connector further includes a counterpressure member held at the connector body, with the contact pressure member or members being disposed on the one side and the counterpressure member or members being disposed on the other side of a second longitudinal center plane which passes perpendicularly through the first longitudinal center plane in the longitudinal axis of the connector.

The connector further comprises a tensioning member with which the contact members and the counterpressure members can be brought into a clamping position and can be fixed in such clamping position. Starting from the receiving position the distance between the contact member and the counterpressure member is greater than the maximum value of the outer diameter of the insulating sheath, while in the clamping position the distance between them is less than the minimum value of the diameter of the conductor.

2. Discussion of the Prior Art

In a known such connector, the connector body is composed of an approximately rectangular tubular section which is formed by bending over the edges of a punched sheet metal member and, at the point of intersection of its first longitudinal center plane with the transverse center plane of a threaded bore disposed in the center of its axial length, has an upper member formed by the one short side of the connector body.

In this prior art connector, a flat contact pressure member formed by a separate punched sheet metal member is disposed parallel to the second longitudinal center plane and is extended on one side and in one piece to form a connecting lug. The contact pressure member, at whose one flat side an actuation screw engages that is screwed into the threaded bore, is provided with a narrow rectangular sheet metal edge bent at a right angle on each side of the transverse center plane in such a manner that both sheet metal edges lie in mutually parallel planes which are also parallel to the transverse center plane and project in the direction of the other short side which forms the base member of the connector body. Both sheet metal edges are given a sawtooth configuration at their free edges.

Essentially in the same planes as these sheet metal edges, pairs of cams formed by embossing project inwardly from the base member of the connector body to serve as counterpressure members. The cams of each pair are disposed on different sides of the first longitudinal center plane and are provided with parallel ridges oriented toward the contact pressure member parallel to the longitudinal axis of the connector. The distance between these ridges corresponds approximately to the diameter of the conductor which is to be contacted by the connector.

In order to be able to easily introduce the conductor into the prior art connector under practice conditions, the inner width between the side members of the connector body must be selected to be considerably greater than the maximum outer diameter of the insulating sheath for which the connector is still to be usable. Special conductors whose insulating sheaths are smaller than this maximum value therefore take up an undefined position within the connector body. Thus, if the actuation screw is tightened, it is unlikely that a sawtooth of the contact pressure member will be seated precisely in the center of the conductor. It must rather be expected that the conductor will be gripped only by the sides of two adjacent sawteeth or will roll into this stable position where, at the occasion of the contacting process, remainders of the insulating sheath remain squeezed in between these edges and the conductor and may prevent reliable contacting even if a great force is exerted, or an oxide layer that may cover the conductor may not be reliably penetrate due to the tangential attack of the sides of the sawteeth.

Since the user of the connector is unable to discern the quality of the contact just made, he will generally tighten the actuating screw excessively, which results in mechanical damage and thus is in the danger of a break at the point of contact, particularly if the conductor is disposed in an unfavorable position within the connector body.

Even if a good contact should be made with the prior art connector, this contact may worsen after some time when the conductor material escapes due to cold flow and thus the contacting pressure is entirely or partially relinquished.

SUMMARY OF THE INVENTION

It is the object of the present invention to modify a connector of the above-mentioned type so that single-wire (solid) or multi-wire (strip-shaped) conductors not equipped with insulating sheaths and having different diameters can be reliably contacted and deformation of the conductor material which would unduly impair the mechanical stability of the conductor as well as worsening of the connector contact due to operational or time dependent influences, particularly due to cold flow of the conductor, are reliably avoided.

This problem is solved in that, according to the invention, each contact pressure member and/or counterpressure member is supported at the supporting component by way of an adjustment spring which transfers the actuating force of the tensioning member.

A first stop is provided for each adjustment spring which comes into engagement after the adjustment spring has traversed a given deformation path, at least partially bridges the spring and takes over the transfer of forces to the contact pressure member or the counterpressure member.

Adjacent to the contact counterpressure member, a centering and constricting device for the line is provided. This device is equipped with jaws having at least three contact faces or edges oriented toward the insulating sheath. At least one contact face is disposed on each side of the first longitudinal center plane and at least one jaw is formed by the counterpressure member.

This configuration accomplishes, on the one hand, that the contact pressure member and the counterpressure member are adjusted so that, even if the conductor is undergoing cold flow, sufficient minimum contacting force is constantly maintained, while, on the other hand, reliable centering of the conductor with respect to the first longitudinal center plane is assured even for insulating sheaths having different diameters, thus making it possible to equip the contact pressure member with contacting elements which can be optimally designed for penetration of the insulating sheath and entrance into the conductor to the desired penetration depth.

Further features and advantages of the invention are defined in the claims and in the description that follows.

BRIEF DESCRIPTION OF THE DRAWINGS

Embodiments of the invention will be described in greater detail below with reference to the drawing figures, in which:

FIG. 1 is a perspective view of a first embodiment of the connector according to the invention;

FIG. 2 is a cross-sectional view of the connector according to FIG. 1 in the clamping position with a conductor having a smaller diameter;

FIG. 3 is a cross-sectional view of the connector of FIG. 1 in the clamping position with a conductor having a larger diameter;

FIG. 15 is a cross-sectional view along line H—H of FIG. 14, but for the connector in the clamping position with a conductor inserted;

FIG. 16 is a longitudinal sectional view along line K—K of FIG. 15 without inserted conductor;

FIG. 19 is a front view of a fifth embodiment of the connector according to the invention in the receiving position;

FIG. 20 is a front view of a connector according to FIG. 19, but in the clamping position (crimped together);

FIG. 21 is a longitudinal sectional view along line M—M of FIG. 20;

FIG. 22 is a top view of a connector according to FIG. 19, but in the clamping position (crimped together);

FIG. 23 is a longitudinal sectional view along line N—N of FIG. 22.

DESCRIPTION OF THE PREFERRED EMBODIMENT

Figure 4:
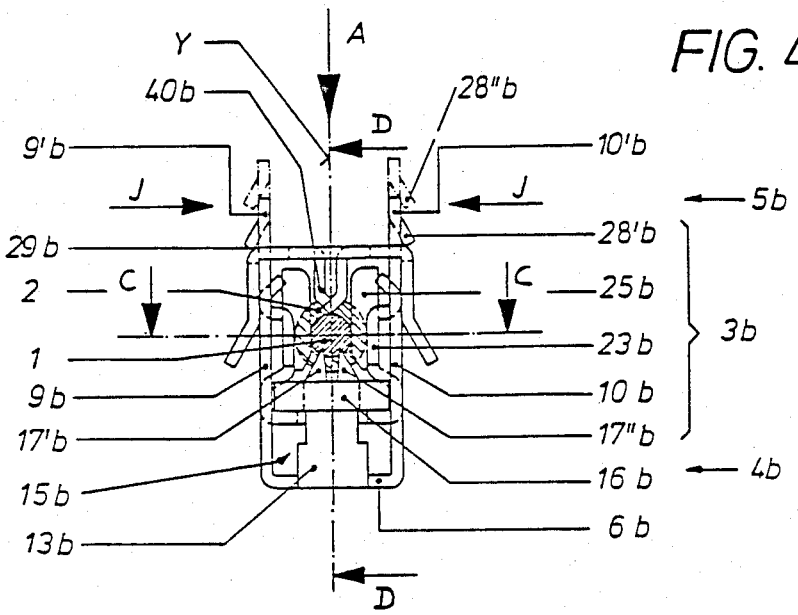
FIG. 4 is a front view of a modification of the first embodiment.

Generally, it must be noted that all connectors (including those of prior art design), corresponding to their structural design and dimensions, are suitable only for lines whose dimensions lie within a certain range. In the sense of the present invention, the terms "given maximum value" for the diameter of the insulating sheath and "given minimum value" for the diameter of the conductor are understood to be those limit dimensions of a line with which the connector configured according to the invention can still reliably perform its intended function, although there may still be advantages over prior art connectors when these limit dimensions are exceeded.

The connector shown in FIGS. 1 to 3 is intended for the connection of a line composed of a metal conductor 1 and an insulating sheath 2 which is brought through the connector in the uncut state, i.e. for example coming from an electrical energy distributor, and is contacted by the connector for connection of a load and then continues to a further load. Additionally, this connector is suitable for the connection of a bare conductor or a line freed of its insulating sheath only at the point of connection and/or a cut line, i.e. a line which is introduced with its exposed end. The connector can further be used for solid as well as multi-wire conductors.

As can best be seen in FIG. 1, the connector includes a connector body marked **3*a* in its entirety, which is composed of a base 4*a* and a cover 5*a* that can be removed to insert the uncut conductor. The connector further has a longitudinal connector axis O (FIG. 3) which is defined by the longitudinal axis of the length section of the line inserted into the clamping chamber of the connector in the receiving position. The insulating sheath of the line has the abovementioned maximum diameter and rests against the components of the connector which limit the clamping chamber in the direction toward a contact pressure member to be explained in greater detail below. The connector further includes a first longitudinal center plane Y extending centrally through base 4*a* and cover 5*a* and including longitudinal connector axis O, as well as a second longitudinal center plane X perpendicular thereto and including longitudinal connector axis O and a transverse center plane Z (see FIG. 6) which divides the connector in the center with respect to its longitudinal extent, is intersected perpendicularly by the longitudinal connector axis O and is disposed close to the sectional planes of FIGS. 2** and 3. Reference will be made to these axes and planes in the description of the further embodiments.

Base 4a is formed of a punched piece of sheet metal and includes a planar, rectangular base member 6a which is parallel to the second longitudinal center plane X and is followed at both its longitudinal sides 7, 8, after 90° bends, by side members 9a, 10a which likewise have a basically planar and rectangular shape and which thus extend to both sides of the first longitudinal center plane Y and parallel thereto. Tongues 13a and 14a which are made of one piece with transverse sides 11 and 12 of base member 6a project from these transverse sides. They are each bent inwardly about 180° in the manner of a hairpin to extend between side members 9a, 10a so that their essentially planar end sections are at the same distance from the inner face of base member 6a and there also remains a space between their ends pointing toward one another. Each tongue 13a, 14a represents a clip spring and both tongues together in their entirety form an adjustment spring 15a which is effective perpendicularly to the second longitudinal center plane X (FIGS. 2 and 3).

A contact pressure member, which in its entirety is marked 16a, rests on this adjustment spring 15a, i.e. on the faces of end sections of tongues 13a, 14a facing away from base member 6a. This contact pressure member is made of a material having good electrical conductivity and has the shape of a rectangular strip which approximately corresponds in size to base member 6a and is disposed with play between side members 9a, 10a. Contact pressure member 16a is extended on one side to form a connecting lug 16' which leads to a device (not shown) which is to be connected by means of the connector, for example a switch or a wall socket or another connector.

A contacting element 17a in the form of a prismatic rib projects from contact pressure member 16a in the direction toward cover 5a. It has a blade-like center edge which lies in the first longitudinal plane Y and extends to both sides of transverse center plane Z for a total length which is greater than the minimum diameter of conductor 1 to be contacted, and preferably three times this diameter. The angle between the faces of the rib forming the blade-like edge is less than or equal to 45°. The hardness of the rib must be greater than the hardness of conductor 1 to be contacted. For universal use of the connector, the Brinell hardness HB of rib 17a should lie above 120 kp/mm$^2$. If the contact pressure member is made of a material which meets these hardness requirements, its rib may also be made of one piece therewith.

Each side member 9a, 10a includes two upper and two lower (closer to base member 6a) inwardly bent flaps 18a and 19a which extend respectively over and under the edge regions of contact pressure member 16a. The upper sides of all four lower flaps 19a lie in a common plane which is parallel to second longitudinal center plane X and together form a first stop 21a which limits the stroke of contact pressure member 16a and of adjustment spring 15a in the sense of compression. The undersides of all four upper flaps 18a lie in another, common plane which is likewise parallel to the second longitudinal center plane but whose distance from base member 6a is greater. They form a second stop 20a which is spaced from base member 6a at such a distance that adjustment spring 15a rests with tension against contact pressure member 16a and holds it against first stop 20a in a form locking manner.

Strip-shaped clip springs have been punched out of side members 9a, 10a in such a manner that these springs are connected with the remaining material of the side members only at lines 22a which are adjacent base member 6a and lie in a plane parallel to second longitudinal center plane X. These clip springs act as pivot levers 23a whose pivot axes are thus parallel to the longitudinal center axis O and lie in the associated side members 9a and 10a, respectively, as well as approximately at the height of adjustment spring 15a and of contact pressure member 16a, respectively.

Adjacent to lines 22a the clip springs are bent inwardly and rest in recesses 16'' a provided at both sides of contact pressure member 16a, thus holding the contact member in a form locking grip in the direction of longitudinal center axis O. Adjacent to their free ends facing away from lines 22a both clip springs are bent about one or a plurality of bending axes, each parallel to longitudinal connector axis O so that sloped faces 24a are produced which, when the clip springs are in an untensioned state, project at least partially beyond the remaining outer faces of the associated side members 9a, 10a and enclose with them an angle, open toward the top, which is substantially greater than 90° and substantially less than 180°.

On their mutually facing faces, the two pivot levers 23a are provided with jaws 25a whose rectangular contact faces 26a extend to both sides of second longitudinal center plane X and transverse center plane Z (FIGS. 2 and 3). Jaws 25a may be formed by length sections of pivot levers 23a themselves and may take up their entire width (in the direction of longitudinal connector axis O), or they may be formed by embossed portions provided thereon.

The free end of each side member 9a, 10a has rectangular cut-outs at either side, such that the side member is extended in the form of two rectangular sheet metal sections 9'a and 10'a between lower end edges which as a whole form a contact surface 27a disposed in a plane parallel to second longitudinal center plane X. Sections 9'a and 10'a each lie on both sides of pivot levers 23. In each sheet metal section 9'a, 10'a deformation has produced an outwardly projecting tongue. All four tongues lie in a common plane parallel to second longitudinal center plane X and form first detents 28a which can be brought into engagement with second detents 29a to be described below.

Cover 5a is composed of a one-piece punched sheet-metal member having a planar rectangular center section 30a, followed at its two long sides 31, 32 by likewise planar and rectangular edge sections 33a and 34a, respectively, which are bent about 90° and which are themselves followed by slightly outwardly oriented rectangular sloped faces 35a and 36a, respectively. The inner distance between long sides 31, 32 is equal to or slightly larger than the outer distance between side sections 9a, 10a of base 4a.

Parallel to and close to long sides 31, 32 of center section 30a, longitudinal slits 37a and 38a are punched into center section 30a and their outer slit edges form the already mentioned second detents 29a. Moreover, two rectangular tongues are punched out of center section 30a and adjacent regions of edge sections 33a, 34a. The tongues are offset with respect to one another and are bent over inwardly along bending lines parallel to the longitudinal axis of the cover so as to face one another. Thus, (when cover 5a has been placed onto base 4a) their free, longitudinally offset successive edges 39'a, 39''a lie essentially in the first longitudinal center plane Y as well as on a straight line parallel to the longitudinal connector axis O. The two tongues together form a counterpressure member 40a which itself is a component of the centering and constricting device including jaws 25a for the line to be contacted. Edges 39'a, 39''a of the counterpressure member facing contact pressure member 16a are configured in such a manner that, due to their greater longitudinal extent and/or the larger angle between the faces forming the edges and/or their greater curvature, they are less able to penetrate into insulating sheath 2 and into conductor 1 than contacting element 17a of contact pressure member 16a.

Aside from connecting lug 16' in base 4a and the offset arrangement of the tongues in cover 5a, the connector is completely symmetrical with respect to first longitudinal center plane Y as well as with respect to transverse center plane Z.

Further features of the connector according to the invention will become evident from the following description of its operation. This description is based on the connection of a solid, uncut conductor 1 having a circular cross-sectional configuration and an insulating sheath 2, the connection of a conductor 1 having a larger diameter and an insulating sheath 2 likewise having a larger outer diameter being discussed in addition.

Conductor 1 is placed into the base 4a of the open connector body 3a (see FIG. 1), where its insulating sheath 2 comes to rest on contacting element 17a of contact pressure member 16a and is disposed between contact faces 26a of jaws 25a. Then, cover 5a is placed onto base 4a, with sheet metal sections 9'a, 10'a of base side members 9a, 10a entering between cover edge members 33a, 34a. Upon further approach of cover 5a toward base 4a, in which case the required pressure force in the direction of arrow A is preferably generated by means of a tool (for example pliers) or by means of a force increasing device incorporated in the connector (for example a pressure screw or a lever or eccentric), the following events are initiated.

The first detents 28a at base 4a run onto sloped faces 35a, 36a at cover 5a, thus bending side members 9a, 10a slightly toward one another in a resilient manner.

Sheet metal sections 9'a, 10'a of side members 9a, 10a begin to pass through longitudinal slits 37a, 38a.

The sloped faces 35a, 36a move onto the sloped faces 24a of pivot levers 23a, thus causing jaws 15a to approach one another with their contact faces 26a, centering conductor 1 with respect to first longitudinal center plane Y and beginning to penetrate its insulating sheath 2.

Counterpressre member 40a presses its edges 39'a, 39''a against insulating sheath 2 and urges it onto the contacting element on the opposite side, with edges 39'a, 39''a and even more so contacting element 17a (rib) penetrating into insulating sheath 2.

Contact pressure member 16a moves against the force of adjustment spring 15a until it comes to rest at first stop 21a.

The edges 39'a, 39''a have now pierced insulating sheath 2 and rest on conductor 1 while contacting element (rib) 17a continues to penetrate into conductors [sic] 1 until the inner face of center cover section 30a contacts contact face 27a and the first and second detents 28a and 29a, respectively, are engaged.

Jaws 25a (whose contact faces 26a are able to advance to conductor 1) see to it that the longitudinal axis L of conductor 1 always remains in the first longitudinal center plane Y and therefore it is always assured that the contacting element penetrates centrally into conductor 1. The relative position of the connector components has here been selected so that, for a conductor 1 having the minimum diameter which the connector can accommodate as its lower limit, the first and second detents 28a and 29a, respectively, are able to engage only if, with contact pressure member 16a resting against the second stop 21a, the space between the contacting element and the edges is smaller by a given amount (for example by 1 mm) than the above-mentioned minimum diameter of conductor 1, with contact face 27a permitting further approach of cover 5a and base 4a only slightly beyond the detent position. Engagement of detents 28a, 29a is thus a certain indication that contacting element 17a has penetrated into the conductor by the amount required for reliable contacting thereof and it is additionally assured that contacting element 17a is unable to completely sever conductor 1. As an additional measure to prevent such an undesirable effect, the height of contacting element 17a may be limited to a value which is less than the minimum diameter of conductor 1.

If, in the course of time, the conductor experiences cold flow, this is compensated by means of adjustment spring 15a which causes contact pressure member 16a to follow and takes care that conductor 1 remains permanently clamped in between counterpressure member 40a and the contacting element (rib 17a) of contact pressure member 16a with a minimum pressure sufficient for reliable contacting.

Adjustment spring 15a is preferably dimensioned so that the force required to lift contact pressure member 16a from second stop 20a in the direction toward first stop 21a is sufficient for contacting element (rib) 17a to pierce insulating sheath 2 as well as a possibly existing oxide layer on conductor 1 and perhaps enter into conductor 1 by a small amount, while, however, this force must not be sufficient for the contacting element to completely sever conductor 1.

In the case shown in FIG. 3 of a thicker conductor 1 with an insulating sheath 2 whose diameter corresponds to the given maximum value for which the connector is designed, this insulating sheath 2 almost completely fills out the space between contact faces 26a of jaws 25a or it rests against their contact faces already with a small amount of tension. The generation of an undesirably high pressure by jaws 25a during the contacting process is prevented by an elastic (possibly also partially plastic) deformation of pivot levers 23a which support contact faces 26a, particularly in the longitudinal sections disposed between sloped faces 24a and jaws 25a. Similarly, the dimensioning and configuration of the tongues which form counterpressure member 40a assures elastic and/or plastic deformability to a degree that, even if contact pressure member 16a rests against first stop 21a, the contacting element is able to penetrate into conductor 1 only with a given maximum force and thus the penetration path of the contacting element is also limited.

To remove the connector from conductor 1 it is sufficient to exert pressure in the direction of arrows J (FIG. 2). This causes side members 9a, 10a of the base to be resiliently bent toward one another, causing detents 28a, 29a to go out of engagement and permitting removal of cover 5a from base 4a and the components to again take on their positions shown in FIG. 1.

In the description below of alternatives and further embodiments, the above explanations should be referred to additionally. Components having the same configuration or acting in the same manner bear the same reference numerals (possibly with different indices).

Figure 5:
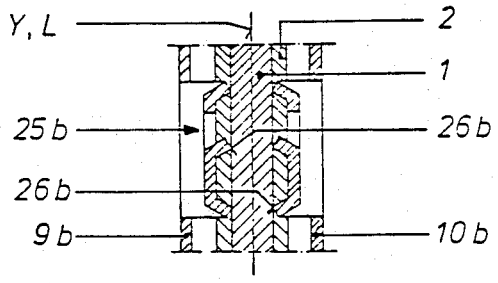
FIG. 5 is a longitudinal sectional view along line C—C of FIG. 4.
Figure 6:
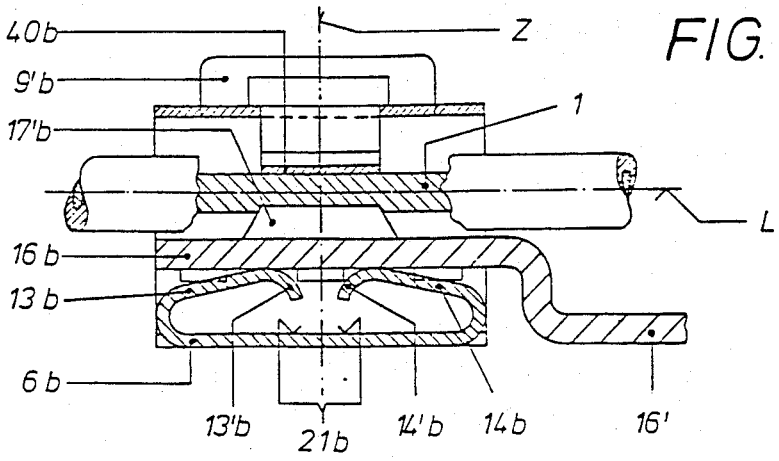
FIG. 6 is a longitudinal sectional view along line D—D of FIG. 4.

In the connector according to FIGS. 4 to 6, the dot-dash lines in FIG. 4 refer to the possibility of extending sheet metal sections 9'b, 10'b of side members 9b, 10b and to form two groups of tongues thereon so that, in addition to the first, inner detents 28b (according to FIGS. 1–3), additional first outer detents 28'b exist. Cover 5b can thus be held on base 4b in an inner detent position in which conductor 1 is contacted properly (detents 29b engage in detents 28b) and in a prior outer detent position which can be realized with less pressure (for example, by means of one's fingers) in the direction of arrow A, in which cover 5b is already retrievably connected with base 4b and a cut conductor can be introduced into the connector in the direction of its longitudinal axis (detents 29b engage in detents 28'b).

The tongues of cover 5b forming counterpressure member 40b have two sections which are parallel to first longitudinal center axis Y so that deformability is reduced and the pressure forces to be exerted on conductor 1 are greater. The free ends of tongues 13b, 14b shaped to base 4b and forming adjustment spring 15b are provided with short 90° bent portions 13'b, 14'b. Their end faces can be brought into contact with the inner face of base member 6b which forms the first stop 21b for contact pressure member 16b. The latter supports contacting elements 17'b, 17''b in the form of two ribs, each disposed on a different side of first longitudinal center plane Y with their blade-like edges being spaced at a distance which is less than the minimum diameter of a conductor 1 that can still be contacted by the connector. Such an embodiment having two juxtaposed contacting elements is intended only for special cases since it was noted that the special advantages of the connector according to the invention were realized with contacting elements whose tips or edges lie in the first longitudinal center plane Y.

To facilitate introduction of the conductor, each jaw 25b is extended close to cover 5b and its contact face 26b is composed of a plurality of sharp edges each extending at least approximately parallel to first longitudinal center plane Y and to transverse center plane Z. These edges are formed at strip-like elements which are partially punched out of the material of pivot lever 23b and are bent over (see, in particular, FIG. 5).

Figure 7:
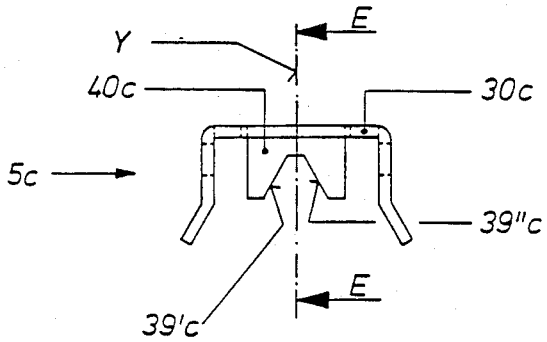
FIG. 7 is a front view of a modified configuration of the cove and of the counterpressure member.
Figure 8:
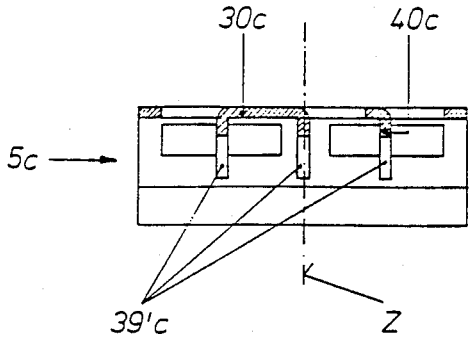
FIG. 8 is a longitudinal sectional view along line E—E of FIG. 7.
Figure 9:
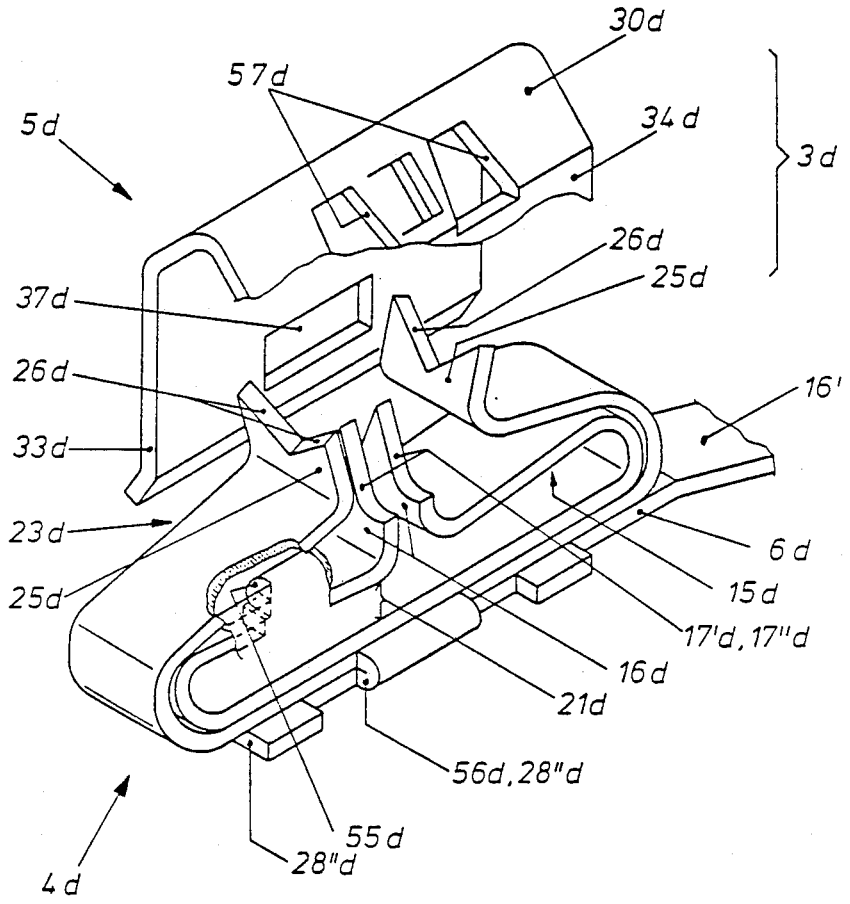
FIG. 9 is a perspective view, partially in section, of a second embodiment of the connector according to the invention.
Figure 10:
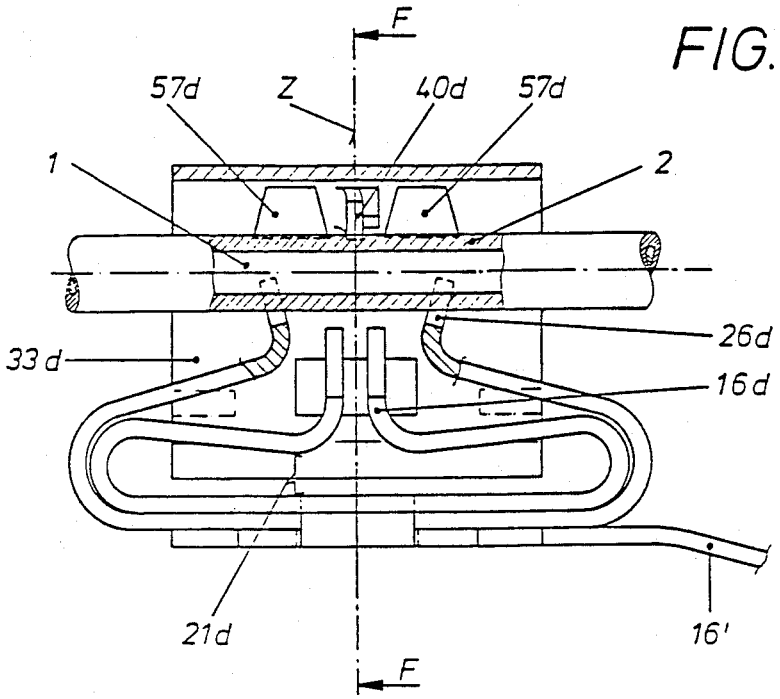
FIG. 10 is a partial longitudinal sectional view in the first longitudinal center plane Y of the connector according to FIG. 9 in the receiving position.
Figure 11:
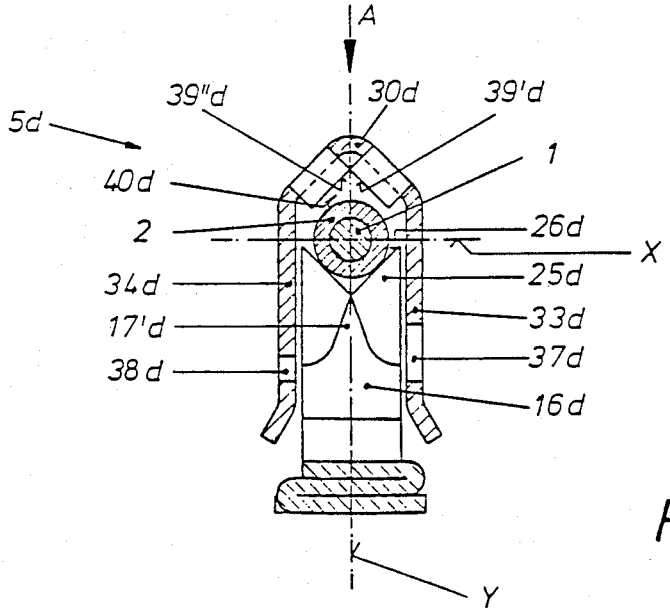
FIG. 11 is a cross-sectional view along line F—F in FIG. 10.
Figure 12:
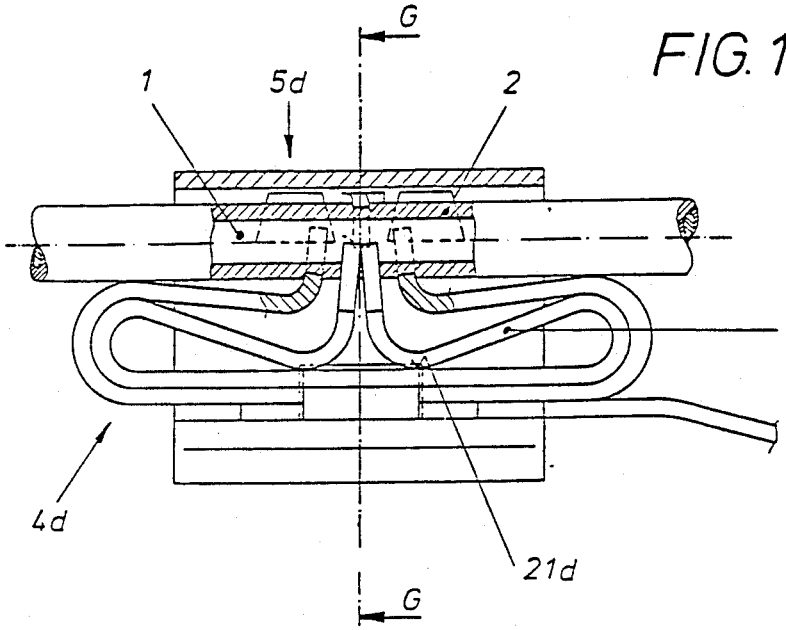
FIG. 12 is a partial longitudinal sectional view in the first longitudinal center plane Y of the connector according to FIG. 9 in the clamping position.
Figure 13:
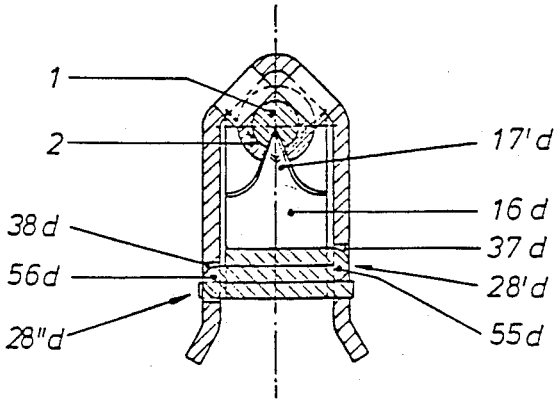
FIG. 13 is a cross-sectional view along line G—G of FIG. 12.
Figure 18:
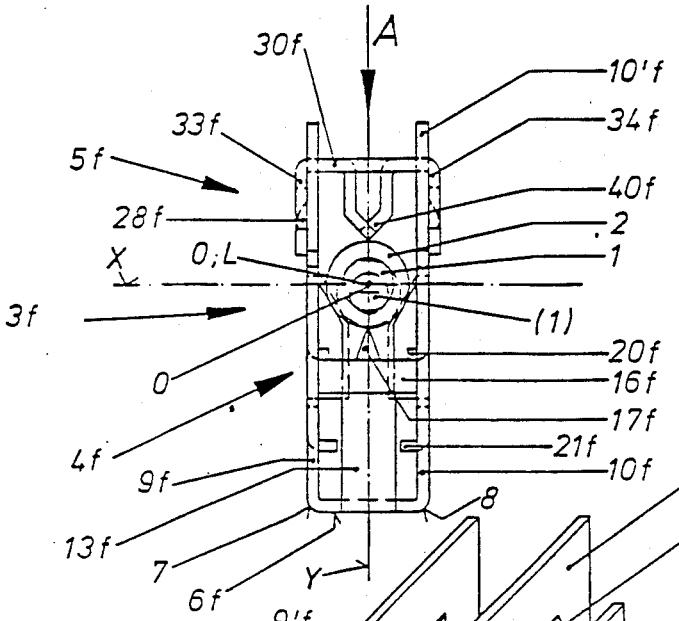
FIG. 18 is a front view of the connector of FIG. 17 including its upper member.
Figure 17:
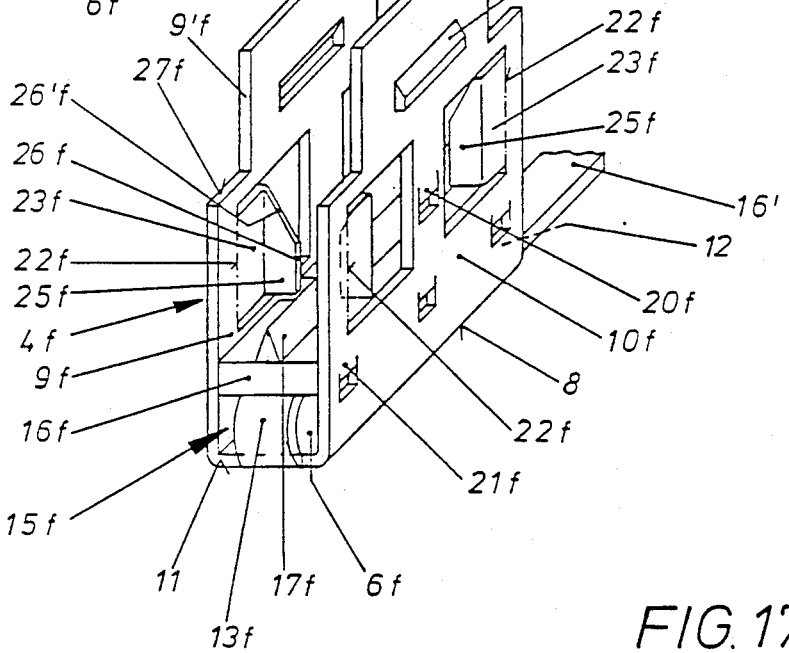
FIG. 17 is a perspective view of the lower portion of a fourth embodiment of the connector according to the invention.

The cover 5c shown in FIGS. 7 and 8 can be used instead of the above-described covers 5a and 5b and, upon appropriate adaptation, also for the embodiment according to FIGS. 18 and 19. Counterpressure member 40c is formed of a plurality of tongues punched exclusively out of center cover member 30c. These tongues are bent inwardly about 90° in a direction parallel to transverse center plane Z and have contact edges 39'c, 39''c formed of trapezoidal cut-outs. They lie in planes parallel to transverse center plane Z so as to improve centering and constriction of the line.

In the connector according to FIGS. 9 to 13 (second embodiment), the adjustment spring 15d formed by two hairpin-like tongues is extended, at both its free ends, to form contact pressure members 16d which are bent at 90°. Contacting elements 17'd, 17''d of these contact pressure members 16d are formed by roof-like end faces in the form of prismatic ribs which are very short in the axial direction and whose edges lie in the first longitudinal center plane Y. Adjustment spring 15d is surrounded by a further spring 23d having two hairpin-like tongues, each continuing at its ends by way of 90° bends as jaws 25d whose ends are provided with triangular cut-outs which each form a pair of sloped contact faces 26d that intersect in the first longitudinal center plane Y. In the receiving position, the edges of contacting elements 17'd, 17''d and the points of intersection of contact faces 26d are approximately in the same plane which is parallel to the second longitudinal center plane X.

One side of the common lower arms of adjustment spring 15d is connected with the common lower arms of spring 23d by means of a first tongue 55d which is bent about 180° and projects laterally to form part of a detent 28'd. A further spring 23d is connected, by way of a second tongue 56d which projects on the other side of the common arm and forms part of a detent 28''d, with a flat base member 6d that is continued as a connecting lug 16'. All above described components form the base 4d of the connector and are made of a one-piece, bent, punched piece of sheet metal.

A cover 5d having edge member 33d, 34d and detent openings 37d, 38d disposed therein for detents 28'd, 28''d can be placed onto this base 4d. In the center portion 30d of this cover 5d, a pair of flaps formed by U-shaped punched-out recesses and, in their entirety, forming counterpressure member 40d, are bent inwardly in such a manner that two sloped contact edges 39'd, 39''d (FIG. 11) are formed in the region of transverse center plane Z. These contact edges (or, more precisely, their imaginary extensions) meet one another in the first longitudinal center plane Y. Further openings 57d in cover 5d serve to permit unimpeded movement of jaws 25d.

The line to be contacted is placed onto contact face 26d and cover 5d is placed on top (FIGS. 10 and 11), this already producing a first centering. Upon further movement of the cover in the direction of arrow A, contact hooks 39'd, 39''d come in contact with insulating sheath 2 and the (further) spring 23d is pressed downwardly, thus increasing the centering action on first longitudinal center plane Y and constricting conductor 1. Contacting elements 17'd, 17''d penetrate into insulating sheath 2 and then slightly into conductor 1. Upon further movement of the cover in the direction of arrow A, adjustment spring 15d is also pressed downwardly until its upper arms come to rest, in the region of the 90° bend, on the joint lower arm (stop 21d). Upon continuation of the movement, contacting elements 17'd, 17''d enter into conductor 1 to the desired extent, whereupon detents 28'd, 28''d drop into detent openings 37d, 38d and prevent further movement, thus holding the connector in the clamped position.

Figure 14:
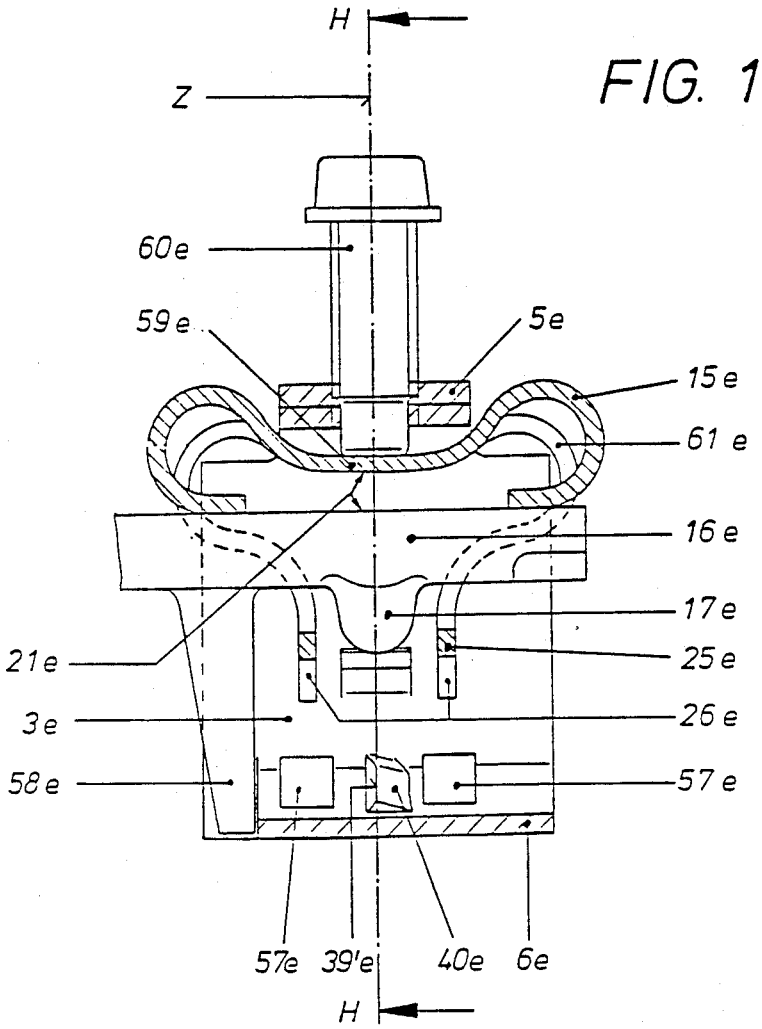
FIG. 14 is a longitudinal sectional view in the first longitudinal center plane Y of a third embodiment of the connector according to the invention in the receiving position.

The third embodiment shown in FIGS. 14 to 16 includes a connector body 3e which basically has the shape of a rectangular tube. The cover (first short side) 5e of connector body 3e includes a threaded bore and a screw 60e as the tensioning member of the connector. A counterpressure member 40e with contact edges 39'e, 39''e is formed at the base (second short side) 6e as described for the second embodiment. Contact pressure member 16e has the shape of a rod having a rectangular cross section with a guide cantilever 58e and contacting element 17e projecting downwardly therefrom.

Between the free end of screw 60e and the upper side of contact pressure member 16e there extends, essentially parallel to second longitudinal center plane X, the common portion 59e of a combined clip spring which almost fills out the inner diameter of connector body 3e. On each side of transverse center plane Z, this spring is divided into three springs that are parallel to first longitudinal center plane Y. The central spring is the adjustment spring 15e for contact pressure member 16e. The outer springs 61e each extend downwardly between the side wall of connector housing 3e and contact pressure member 16e. Springs 61e, which lie on the same sides of transverse center plane Z are combined, at a distance from the underside of contact pressure member 16e, to form a jaw 25e which has downwardly oriented contact faces 26e.

When screw 60e is actuated, the line is centered by jaws 25e which engage it first and, in cooperation with abutment edges 39'e, 39''e, it is bundled, whereupon contacting element 17e in the form of a sharp-edged lens begins to enter into the line, the force required for this being initially transferred by adjustment spring 15e and then by a stop 21e between joint spring member 59e and the upper side of contact pressure member 16e.

In the fourth embodiment of the connector, shown in FIGS. 18 and 19, the base 4f is formed of a punched-out sheet metal member and contains a planar, rectangular base member 6f which is parallel to second longitudinal center plane X and is followed, at its two longitudinal sides 7, 8 and by way of 90° bends, by side members 9f, 10f which likewise are basically planar and rectangular and which thus extend to both sides of first longitudinal center plane Y and parallel thereto. Tongues 13f formed in one piece with frontal faces 11 and 12 of base member 6f project therefrom and are bent inwardly about 180° in the form of a hairpin to enter between side members 9f, 10f in such a manner that their essentially planar end sections are spaced from one another and parallel to the inner face of base member 6f, while a space likewise remains between their mutually facing ends. Each tongue 13f represents a clip spring and both tongues together, in their entirety, form an adjustment spring 15f which is active perpendicularly to second longitudinal center plane X.

On this adjustment spring, namely on the faces of the end sections of tongue 13f facing away from base member 6f, there lies a contact pressure member, identified in its entirety by the numeral 16f, which is composed of a material having good electrical conductivity and has the shape of a rectangular strip, approximately corresponding to the size of base member 6f which is disposed with play between side members 9f, 10f. Contact pressure member 16f is extended at one side by way of a crimp into a connecting lug 16' which leads to a device (not shown) to be connected by mean of the connector or to another connector.

A connecting element 17f in the form of a prismatic rib projects from contact pressure member 16f in the direction toward cover 5f. The blade-like center edge of this contacting element lies in first longitudinal center plane Y and extends to both sides of the transverse center plane with a total length which is greater than the minimum diameter of the conductor 1 to be contacted; preferably it is three times this diameter. The angle between the faces of the rib forming the blade-like edge is smaller than or equal to 45°. As in the other embodiments, the hardness of the rib must be greater than the hardness of the conductor 1 to be contacted.

Each side member 9f, 10f has two groups of inwardly bent flaps which, as described in detail for the first embodiment, form a first and a second stop 21f, 20f to limit the strokes of contact pressure member 16f and adjustment spring 15f.

Two strip-shaped clip springs 23f which act as pivot levers are punched out of each side member 9f, 10f, so that they are connected with the remaining material of the side members only along lines 22f adjacent the frontal ends of base 4f which lie in planes parallel to the transverse center plane. The free ends of clip springs 23f are bent inwardly about 90° and their end sections form jaws 25f having contact faces 26f that are parallel to first longitudinal center plane Y and are followed at the top by support faces 26'f in the form of sloped faces.

The free end of each side member 9f, 10f is provided with rectangular cut-outs on both sides, such that each side member is extended in the form of a rectangular tongue 9'f, 10'f between the lower end edges which, as a whole, form a face 27f that lies in a plane parallel to second longitudinal center plane X. By means of deformation, an outwardly projecting catch is formed at each tongue. All catches lie in a common plane which is parallel to second longitudinal center plane X and form first detents 28f which can be brought into engagement with second detents to be described later.

Cover 5f is configured analogously to the first embodiment or, more precisely, its modification shown in FIGS. 4 to 6, and therefore does not require further description.

Aside from the offset arrangement of the tongues in cover 5f, the connector is completely symmetrical with respect to the first longitudinal center plane Y as well as with respect to the transverse center plane.

When a line is inserted, its conductor 1 is centered by jaws 18f with respect to first longitudinal center plane Y and compressed independently of the diameter of insulating sheath 2, so that contacting element 17f penetrates into the center of insulating sheath 2 and the conductor when pressure is applied to cover 5f in the direction of arrow A.

The fifth embodiment of the connector shown in FIGS. 19 to 23 is intended for the one-time (non-releasable) connection of a line having a multi-wire conductor 1. This connection requires a tool, preferably specially configured crimpers.

All parts of the connector are made of a one-piece punched-out piece of sheet metal which is shaped by bending. Its connector body 3g includes a planar base member 6g which is parallel to second longitudinal center plane X and which is followed at each of its long sides 7, 8 parallel to longitudinal connector axis O, by way of 90° bends, by a planar, rectangular side member 9g, 10g which is symmetrical to transverse center axis Z. Side members 9g, 10g thus extend parallel to first longitudinal center plane Y and on different sides of this plane. They are disposed at the sam distance from that plane, with the distance of their facing inner faces essentially corresponding to the given maximum value of the diameter of insulating sheath 2. This means that the distance must be set so that a line having this diameter can be introduced between side members 9g, 10g with relatively little force and only slight deformation of insulating sheath 2, or that a minimum amount of play remains to permit insertion of the line without the use of force.

The one side member 9g is extended, in its center (i.e. to both sides of transverse center plane Z) and toward its free long side 7' which is parallel to long side 7, in a narrow rectangular tongue 9'g whose height is less than the distance between side members 9g, 10g, but greater than onehalf this distance.

The other side member 10g has a height (distance between long sides 8 and 8') which is less by its thickness than the height of the one side member 9g and has a width, measured in the direction of longitudinal connector axis 0 which exceeds the length of the one side member 9g by about twice its thickness. This other side member 10g is extended in its center (i.e. to both sides of transverse center plane Z) and toward its free long side 8' which is parallel to long side 8, in a rectangular tongue 10'g whose height almost corresponds to the distance between side members 9g, 10g, while its width measured in the direction of longitudinal connector axis O is less by about twice its thickness than the width of the one side member 9g. Approximately in the center of its surface, tongue 10'g has a rectangular opening 50g. Starting at each frontal face, tongue 10'g has two short cuts 51g which are parallel to longitudinal connector axis O. Between these cuts, flaps remain standing which, as will be described below, form a counterpressure member 40g in the clamping position, with contact edges 39'g, 39''g being formed by way of a triangular cut-out.

Clamping body 3g also includes, at each frontal face, two partially overlapping frontal pieces which extend parallel to transverse center plane Z and follow, by way of 90° bends, side members 9g and 10g while leaving a gap with respect to base member 6g. These front members form pairs of jaws 25g having contact faces 26g and are held immovably at connector body 3g. They will be described below. In the region of contacting element 17g, contact faces 26g belonging to one pair of jaws extend parallel to first longitudinal center plane Y and at the same distance therefrom. The distance between them is less than the given minimum value for the diameter of the metal conductor 1 to be contacted. Above the region of contacting element 17g, i. e. above a plane passing through the cutting edge of the contacting element and parallel to the second longitudinal center plane X, the parallel contact faces 26g change to guide faces 26'g which become steadily wider toward side members 9g, 10g.

At its one frontal face, base member 6g is continued in the form of a connecting lug 16' which establishes the electrical connection of the connector with another connector or a device to be connected. At the other frontal face, base member 6g continues as a tongue which is slightly less narrower than base member 6a. A first section of this tongue has approximately the shape of a hairpin (whose one arm simultaneously forms base member 6g) and constitutes an adjustment spring 15g which projects outwardly with its part bent by about 180° beyond the pair of jaws 25g facing away from connecting lug 16'. Its other, approximately linear arm passes through the gap between the pair of jaws and base member 6g back into the interior of the connector. This further arm is followed, by way of a bend location of approximately 90° which lies approximately in transverse center plane Z, by a further linear portion which forms contact pressure member 16g of the connector. This contact pressure member becomes narrower at its free end to form an edge lying in first longitudinal center plane Y, with the narrowing portion forming contacting element 17g of the contact pressure member intended to enter into conductor 1.

In FIG. 21, contact pressure member 16g and adjustment spring 15g are shown with solid lines in the clamping position, while the dot-dash line shows the position of these members in the receiving position of the connector. This FIG. 21 shows that a first stop 21g is formed between the 90° bend connecting the contact pressure member with the adjustment spring and base member 6g to limit the path of the contact pressure member relative to the remainder of the connector housing in the sense of compressing the adjustment spring. A second stop 20g which is effective in the opposite direction is provided between the approximately linear portion (arm) of adjustment spring 15g and the one pair of jaws 25g.

To connect a line, the line is placed from the top into the connector (FIG. 19) in the receiving position and is then disposed between tongues 9'g, 10'g to place itself against the broadened guide faces 26'g of jaws 25g. Then the line is pressed deeper into the connector in the direction of arrow A by means of pliers or an instrument specially designed for this purpose, thus initially centering and compressing (constricting) conductor 1 with respect to first longitudinal center plane Y by means of guide faces 25'g and then by means of contact faces 26g.

During this process, contacting element 17g begins to penetrate into insulating sheath 2 and then into conductor 1, with the force required for this penetration progressively increasing. Once this force reaches a defined value, disengagement from the second stop 20g occurs (FIG. 21) and adjustment spring 15g is increasingly compressed until finally first stop 21g becomes effective and prevents further movement of contact pressure member 16g and its contacting element 17g. The force exerted on the line in the direction of arrow A is thus fully effective for penetration of contacting element 17g into conductor 1 (aside from friction forces at guide faces 26g) so that the contacting element penetrates deeply into the conductor.

Thereafter, a specially designed crimper is used to bend tongue 10'g inwardly about approximately 90° in the direction of arrow B', with the free end of tongue 9'g continuing to be bent into opening 50g in the direction of arrow B''. The two flaps of tongue 10'g are simultaneously or subsequently bent inwardly by about 45°, enabling contact edges 39'g, 39''g to penetrate insulating sheath 2 and advance to conductor 1. The abovementioned bent components in their entirety form a counterpressure member 40g for the contact pressure member and, together with contact faces 26g, they constitute a component of the centering and constricting device of the connector.

The connector in the clamping position is shown in FIGS. 20 to 23. If, in the course of time, conductor 1, although it is practically unable to escape due to the presence of the counterpressure member and contact faces 26g, indicates a tendency to move away from contacting element 17g, the adjustment spring causes the contact pressure member and contacting element 17g to follow, thus lifting it from first stop 21g.

The protective range of the present invention is not limited to the embodiments described and illustrated in the drawings. Rather, numerous modifications and other configurations are possible (for example, a combination of components of the described embodiments) as long as these realize the essential measures of the invention listed below.

Centering the line during the clamping process with respect to first longitudinal center plane Y before the contacting element contacts the line and before the contacting element has penetrated into the line to the extent that a subsequent position correction is no longer possible or only with a great amount of force and/or by greatly destroying conductor 1. The goal of this centering process is to make available an optimum position for the metal conductor of the line with respect to the contacting element so that the contacting element (whose tip is preferably disposed in the first longitudinal center plane) enters the circumference of the conductor in the center.

During centering, the conductor is also constricted, i.e. a plurality of forces directed in the direction toward the longitudinal axis L of the conductor compress the line. The aim of this constriction is to make the centering process more effective even if, for example, the insulating sheath has a reduced or irregular mechanical deformation resistance at higher temperatures and, if the line includes a multi-wire metal conductor, its individual wires can be better bundled so that they rest against the contacting element with a pressure which is sufficient to establish a good contact.

Centering and constriction of the line is maintained until the contacting process is completed (the contacting element has taken up its intended position within the conductor) and is maintained as long as the connector is in the clamping position. The aim of this measure is to bring the contacting element into the most advantageous (centered) position within the conductor (even during the adjustment to be described below).

After completion of the contacting process and as long as the connector is in the clamping position, the contact pressure member is held against the counterpressure member by means of a spring member specially provided for this purpose and under spring tension in the direction toward the counterpressure member spring path is made available which is greater than the spring path inevitably resulting to a slight extent in prior art connectors on the basis of the elastic properties of all known materials even in components which are not configured specifically to produce a spring effect. The aim of this measure is to maintain a low transfer resistance between contacting element and conductor, even if the conductor or part of the insulating sheath disposed between the conductor and the counterpressure member is deformed in the course of time and/or tends to lift away from the contacting element. This can happen for example as a result of cold flow, the influence of heat, shocks to which the connector is subjected or external forces acting on the line.

A stop is provided which limits the bending path of the adjustment spring and the stroke of the contact pressure member and which is arranged and configured in such a manner that, whenever it becomes effective, the contacting element takes on a position in the connector which corresponds to the intended final position of the contacting element in the conductor when the connector is in the clamping position. The stop serves the purpose of making available, on the one hand, a force in the contact pressure member supporting the contacting element sufficiently high to produce deep penetration of the contacting element and, on the other hand, a reliable indication, in the form of the stop becoming effective, that sufficient contact has been established between the contacting element and the conductor.

I claim:

1. In a connector for the electrical connection of a line without prior removal of its insulating sheath, the sheath having a diameter of at most a first predetermined value and enclosing a conductor having an approximately circular cross section, the diameter of the conductor being at least a second predetermined value, said connector having at least one clamping chamber into which a longitudinal section of the line can be introduced and whose diameter approximately corresponds to said first predetermined value, said connector comprising:

a connector body;

at least one contact pressure member having at least one contacting element for penetrating the insulating sheath and contacting the conductor of the line, said contact pressure member having a tip which lies in a first longitudinal center plane of the connector which includes the longitudinal axis of the connector;

at least one counterpressure member being disposed in said connector body, said contact pressure member being disposed on one side of a second longitudinal center plane which passes perpendicularly through the first longitudinal center plane which includes the longitudinal axis of the connector and said counterpressure member being disposed on the other side of the second longitudinal center plane; and a tensioning member wherein said counterpressure member and said contact member can be moved form a starting position to a clamping position such that when said counterpressure member and said contact member are in the clamping position, the distance which they are apart is less than said second predetermined value, and the improvement comprising:

an adjustment spring means which supports at least one of said contact pressure member and said counterpressure member in said connector body and transfers the actuating force of the tensioning member;

a stop provided for partially bridging said adjustment spring means so as to transmit a force to said contact pressure member and the counterpressure member; and a centering and constriction means including jaws having at least three contact faces with a portion of said faces being disposed adjacent the insulating sheath, said centering and constriction means being adjacent to said contact pressure member, at least one contact face of said jaw being disposed on each side of the first longitudinal center plane and at least one jaw being formed by said counterpressure member.

2. A connector as defined in claim 1, wherein said adjustment spring means is a shaped sheet metal member which is integral with part of said connector body.

3. A connector as defined in claim 1, wherein said stop is formed directly at a component of said adjustment spring means.

4. A connector as defined in claim 1, wherein said adjustment spring means is disposed between a component of said connector body and said contact pressure member which is movably mounted with respect to said component.

5. A connector as defined in claim 1, further comprising an actuation screw connected to said connector body wherein said adjustment spring means is disposed between a free end of said actuation screw and said contact pressure member mounted so as to be movable relative to said connector body.

6. A connector as defined in claim 1, wherein each said counterpressure member is provided with contact faces which are arranged at an angle to one another and which extend at least approximately tangentially to the insulating sheath.

7. A connector as defined in claim 1, wherein said counterpressure member is connected with said connector body by means of a member that is deformable by bending, with said connector being brought from the starting position to the clamping position by bending said member.

8. A connector as defined in claim 1, wherein said stop is formed between said contact pressure member and said connector body.

9. A connector as defined in claim 1, wherein said connector body includes a base having side members and a cover, said cover grips outwardly over said side members of said base by means of downwardly projecting edge portions which are essentially parallel to said first longitudinal center plane.

10. A connector as defined in claim 1, wherein said contacting element is made of a material having a Brinell hardness of at least 120 kg.mm$^2$.

11. A connector as defined in claim 1, wherein said contacting element is formed by a rib whose side faces intersect in an edge at an angle of less than 90°, said edge facing the counterpressure member and lying said first longitudinal center plane.

12. A connector as defined in claim 1, wherein said contacting element is a lens-shaped body which is divided in its longitudinal axis.

13. A connector as defined in claim 1, further comprising a plurality of pivot levers, wherein at least two jaws are connect to each pivot lever.

14. A connector as defined in claim 13, wherein said pivot levers are clip springs.

15. A connector as defined in claim 1, wherein at least two jaws are movably arranged on both sides of the first longitudinal center plane and said jaws being movably coupled with one another in the region of the second longitudinal center plane so that when the connector is moved into the clamping positions by actuation of the tensioning member, said jaws are brought closer to the first longitudinal center plane.

16. A connector as defined in claim 15, further comprising edge members which end in sloped faces, and said jaws include respective pivot axes so that said sloped faces can be brought into engagement with said sloped faces and said sloped faces comprise a mechanism for moving said jaws.

17. A connector as defined in claim 1, wherein at least one jaw of said connector body being immobile and disposed on each side of said first longitudinal center plane.

18. A connector as defined in claim 17, wherein the distance from the first longitudinal center plane of said contact faces of said immobile jaws in a plane parallel to the second longitudinal center plane is the same and this distance is at least one half of said first predetermined value and in the region of said contacting element, this distance is reduced such that it is less than one-half of said second predetermined value.

19. A connector as defined in claim 17, wherein in the region of said contacting elements, said contact faces extend parallel to said first longitudinal center plane.

20. A connector as defined in claim 1, wherein said adjustment spring means is formed by at least one strip-shaped clip spring.

21. A connector as defined in claim 20, wherein said adjustment spring is hairpin shaped.

22. In a connector for the electrical connection of a line without prior removal of its insulating sheath, the sheath having a diameter of at most a first predetermined value and enclosing a conductor having an approximately circular cross section, the diameter of the conductor being at least a second predetermined value, said connector having at least one clamping chamber into which a longitudinal section of the line can be introduced and whose diameter approximately corresponds to said first predetermined value, said connector comprising:

a connector body;

at least one contact pressure member having at least one contacting element for penetrating the insulating sheath and contacting the conductor of the line, said contact pressure member having a tip which lies in a first longitudinal center plane of the connector which includes the longitudinal axis of the connector;

at least one counterpressure member being disposed in said connector body, said contact pressure member being disposed on one side of a second longitudinal center plane which passes perpendicularly through the first longitudinal center plane which includes the longitudinal axis of the connector and said counterpressure member being disposed on the other side of the second longitudinal center plane; and wherein said counterpressure member and said contact member can be moved from a starting position to a clamping position such that when said counterpressure member and said contact member are in the clamping position, the distance which they are apart is less than said second predetermined value, and the improvement comprising:

an adjustment spring means which supports at least one of said contact pressure member and said counterpressure member in said connector body and transfers a force thereto;

a stop provided for partially bridging said adjustment spring means so as to transmit a force to said contact pressure member and the counterpressure member; and a centering and constriction means including jaws having at least three contact faces with a portion of said faces being disposed adjacent the insulating sheath, said centering and constriction means being adjacent to said contact pressure member, at least one contact face of said jaw being disposed on each side of the first longitudinal center plane and at least one jaw being formed by said counterpressure member.

* * * * *